US006341649B1

(12) United States Patent
Joshi et al.

(10) Patent No.: US 6,341,649 B1
(45) Date of Patent: Jan. 29, 2002

(54) ALUMINUM PLATE OIL COOLER

(75) Inventors: Shrikant Mukund Joshi, Williamsville; Frederick Vincent Oddi, Orchard Park; Timothy John Peters, Lockport, all of NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/781,709

(22) Filed: Feb. 12, 2001

(51) Int. Cl.[7] ..... F28D 1/02
(52) U.S. Cl. ..... 165/153; 165/167; 165/916
(58) Field of Search ..... 165/109.1, 152, 165/153, 167; 123/196 AB, 41.33; 184/104.3

(56) References Cited

U.S. PATENT DOCUMENTS

| | | | | | |
|---|---|---|---|---|---|
| 821,422 | A | * | 5/1906 | McR. Livingston | 165/153 |
| 4,815,532 | A | * | 3/1989 | Sasaki et al. | 165/153 |
| 5,014,775 | A | * | 5/1991 | Watanabe | 165/167 |
| 5,036,911 | A | * | 8/1991 | So et al. | 165/153 |
| 5,636,685 | A | | 6/1997 | Gawve et al. | 165/109.1 |
| 5,794,691 | A | * | 8/1998 | Evans et al. | 165/167 |
| 5,918,664 | A | * | 7/1999 | Torigoe | 165/153 |
| 5,983,992 | A | * | 11/1999 | Child et al. | 165/167 |
| 6,170,567 | B1 | * | 1/2001 | Nakada et al. | 165/153 |
| 6,216,775 | B1 | * | 4/2001 | Hedman | 165/167 |
| 6,220,340 | B1 | * | 4/2001 | Cheong et al. | 165/916 |
| 6,260,612 | B1 | * | 7/2001 | Nakamura et al. | 165/153 |

FOREIGN PATENT DOCUMENTS

| | | |
|---|---|---|
| WO | WO93/10415 | 5/1993 |

* cited by examiner

*Primary Examiner*—Ira S. Lazarus
*Assistant Examiner*—Terrell McKinnon
(74) *Attorney, Agent, or Firm*—Patrick M. Griffin

(57) ABSTRACT

The aluminum plate oil cooler includes a plurality of pairs of plates that are secured along their perimeter to define an oil flow path. The plates include embossed regions that are formed to provide inlet and outlet ports for the oil. Top and bottom reinforcement plates are positioned at the top and bottom of the plurality of pairs of plates. An internal center is positioned between the plates to increase the heat transfer area and turbulate the oil within the oil cooler. An external center is positioned between each of the plurality of pairs to increase the thermal transfer area on the coolant side of the oil cooler. The external center covers the entire surface of the plates and includes holes formed to correspond with the embossed regions on the plates.

9 Claims, 3 Drawing Sheets

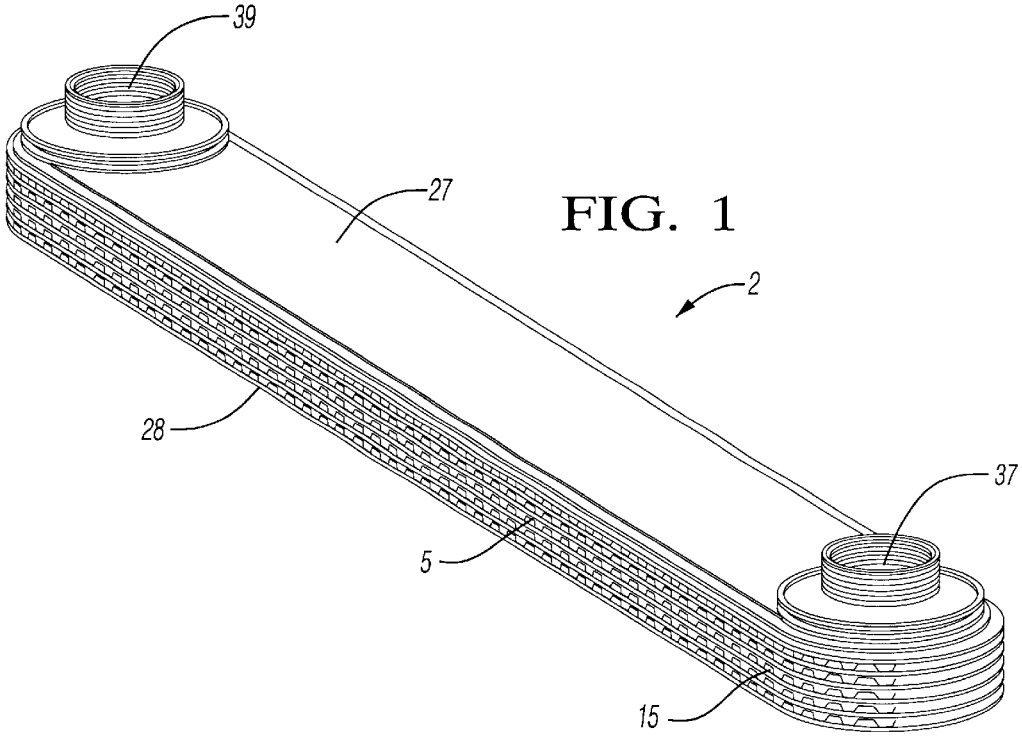
FIG. 1
FIG. 8
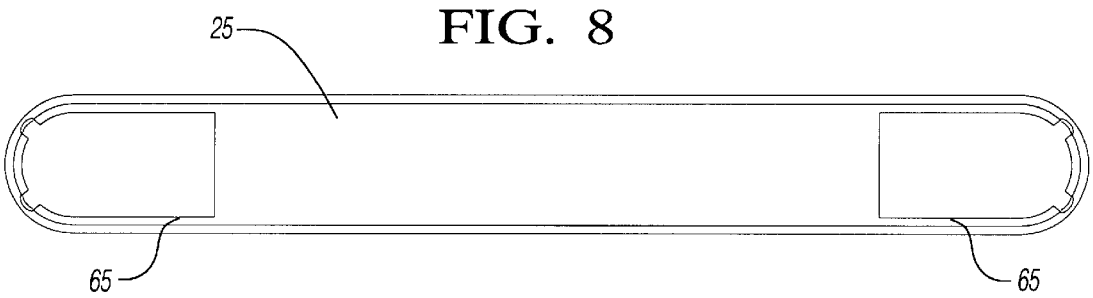
FIG. 9
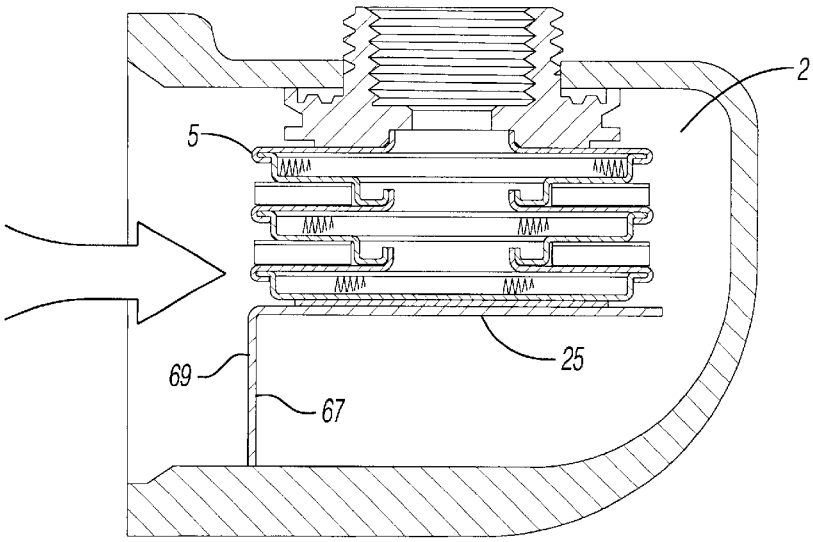

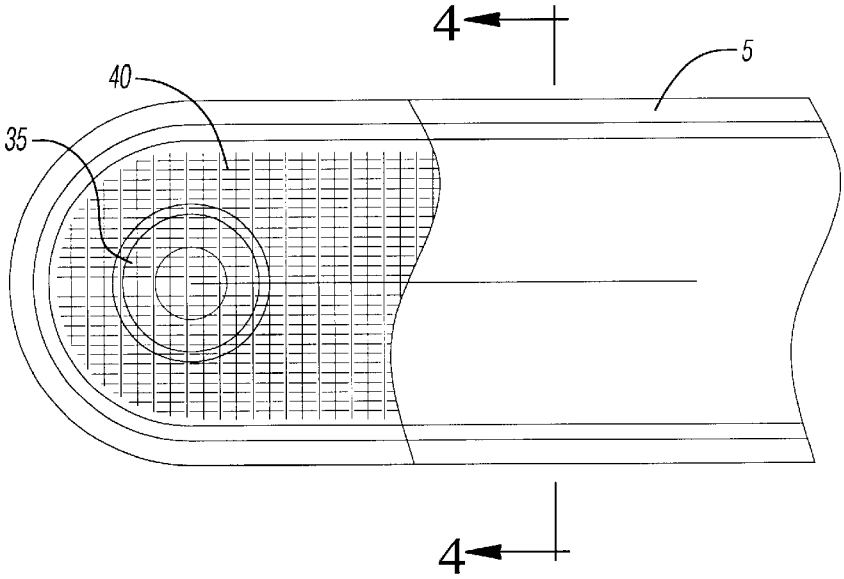
FIG. 3
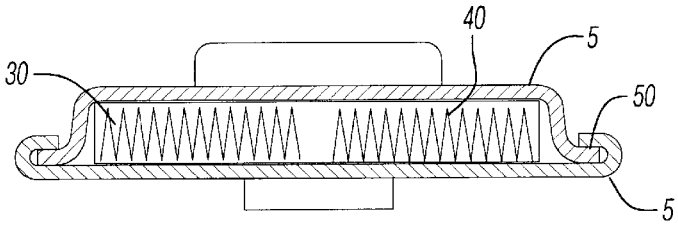
FIG. 4
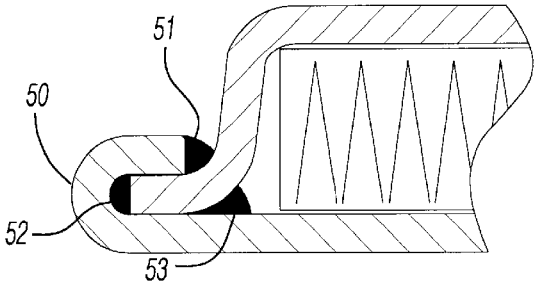
FIG. 5
FIG. 6
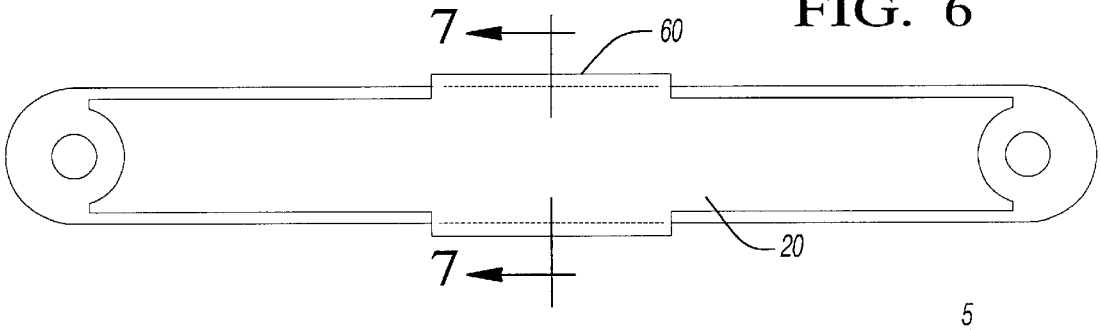
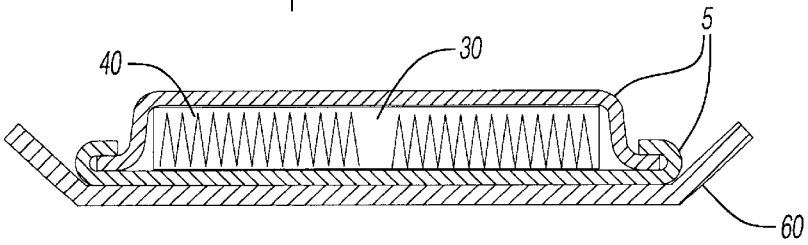
FIG. 7

ALUMINUM PLATE OIL COOLER

BACKGROUND OF THE INVENTION

This invention generally relates to aluminum plate oil coolers. With more particularity, the invention relates to aluminum plate oil coolers having an internal and external center covering the entire surface of the plates forming the aluminum plate oil cooler. "Center" refers to the individual finned surfaces in contact with the oil cooler plates. The centers can be positioned internally (oil side) or externally (water or coolant side) of the oil cooler.

Plate oil coolers are used to cool transmission or engine oil utilized in cars and trucks. The oil coolers are placed in the vehicle radiator inlet or outlet coolant tanks to provide a means for exchanging the heat from the oil to the coolant. Plate oil coolers are produced utilizing a variety of metals. Construction materials include cupre-nickel and stainless steel plates with steel fin or center surfaces braced between the plates. The fin surfaces turbulate or mix the oil and improve the surface area available for heat transfer from the oil to the coolant.

In an effort to reduce the costs associated with the production of automobiles as well as improve the mileage performance of automobiles, alternative materials such as aluminum have been considered for use in plate oil cooler designs. The aluminum oil coolers have advantages over conventional materials, such as a substantial weight savings due to the lower density of aluminum, as compared to the higher density stainless steel construction materials. Aluminum also has a higher thermal conductivity as compared to some of the common construction materials; thereby, allowing additional cost and weight savings by eliminating the need for one or more plates from a conventional design.

One drawback of utilizing aluminum as a construction material is the lower yield strength as compared to other construction materials such as stainless steel. Because of the high pressure, usually from 50 to 150 PSI, that an oil cooler must contain under typical operating conditions and the subsequent burst requirements of up to 500 psi, special design considerations must be utilized for aluminum plate coolers.

Accordingly, it is an object of the present invention to provide an aluminum plate oil cooler that has an increased burst strength and pressure cycle life. It is also an object of the present invention to provide an aluminum plate oil cooler that may be manufactured with an increased strength and resistance to leaks by a brazing operation.

SUMMARY OF THE INVENTION

There is provided, an aluminum plate oil cooler which cures those deficiencies outlined above and provides an oil cooler having excellent durability, increased strength and is easier to manufacture. The aluminum plate oil cooler of the present invention includes a plurality of pairs of plates that are secured along their perimeter to define an oil flow path. The plates include embossed regions that are formed to provide inlet and outlet ports for the oil. Top and bottom reinforcement plates are positioned at the top and bottom of the plurality of pairs of plates. An internal center is positioned between the plates to increase the heat transfer area and turbulate the oil within the oil cooler. An external center is positioned between each of the plurality of pairs to increase the thermal transfer area on the coolant side of the oil cooler. The external center is a corrugated aluminum sheet having fins formed on the sheet such that the flow of the coolant is perpendicular to the flow of the oil. The external center covers the entire surface of the plates and includes holes formed to correspond with the embossed regions on the plates. This design provides a uniform internal load on the plates to insure a quality bond between the internal center and plates during a brazing operation.

BRIEF DESCRIPTION OF THE DRAWINGS

The various advantages of the present invention will become apparent to one skilled in the art by reading the following specification and claims, and by referencing the following drawings in which:

FIG. 1 is a perspective view of the oil cooler.

FIG. 3 is a plan view of a plate and internal center.

FIG. 4 is a sectional view showing the plates secured along their perimeter.

FIG. 5 is an enlarged view showing the brace points formed by the plate seams.

FIG. 6 is a plan view of a top reinforcement having a flow diverter.

FIG. 7 is a sectional view of the top reinforcement having a flow diverter.

FIG. 8 is a plan view of the bottom reinforcement plate of the cooler.

FIG. 9 is a sectional environmental view of the oil cooler with a bottom reinforcement including a baffle.

DETAILED DESCRIPTION OF THE PREFERRED EMBODIMENT

Figure 2:
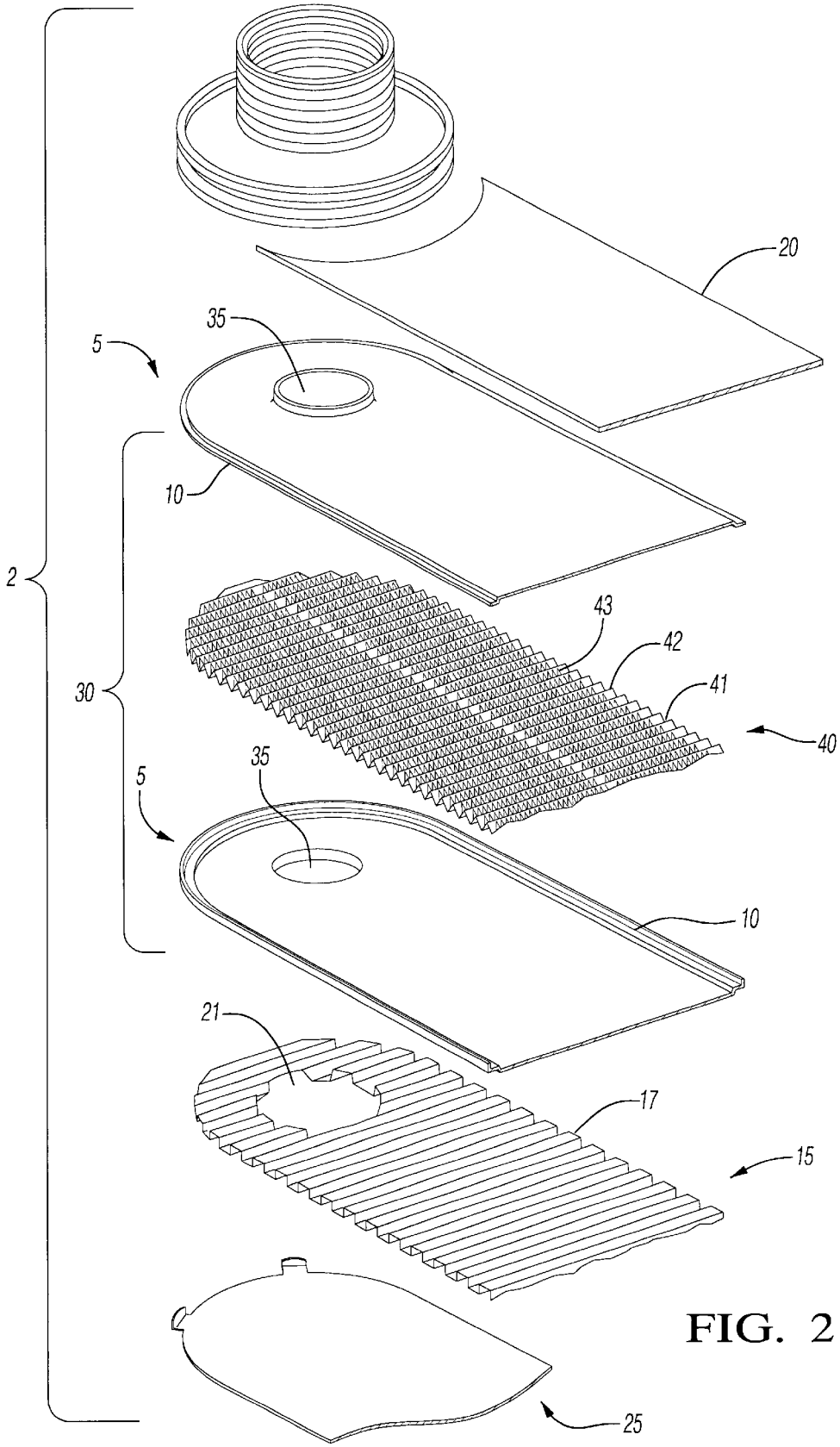
FIG. 2 is an exploded perspective view of the oil cooler.

With reference to FIGS. 1 and 2, there is shown the aluminum plate oil cooler 2 of the present invention. The aluminum plate oil cooler 2 includes a plurality of pairs of plates 5 that are secured together around their perimeter 10. The plurality of pairs of plates 5 are separated from each other by an external center 15. There is also included, a top and bottom reinforcement 20 and 25 respectively, positioned on the top 27 and bottom 28 of the plurality of pairs of plates 5.

With reference to FIG. 2, the plurality of pairs of plates 5 are secured along their perimeter 10 such that the plates 5 are spaced from each other to define an oil flow path 30. The plates 5 include embossed regions 35 formed on opposite ends of the plates for providing inlet and outlet ports, 37 and 39 respectively, for the oil to enter the oil flow path 30.

An internal center 40 is positioned between the plates 5 and within the oil flow path 30 for transferring the heat from the oil within the oil flow path 30 to the plates 5. The internal center 40 increases the heat transfer by providing additional surface area for contact with the oil. The internal center 40 comprises a corrugated or folded sheet of metal forming generally planer fins 41 in side-by-side relationship enjoined by bends 42. Each of the fins 41 has a set of louvers 43 extending over most of the fin area. The fins 41 extend transverse to the direction of oil flow such that the oil must flow through the louvers 43 of each fin to pass from the inlet 37 to the outlet 39. The description of the type of internal center utilized by the present invention is similar in design to that disclosed in U.S. Pat. No. 4,945,981 which is herein incorporated by reference. As stated previously, the design is similar but there are several differences which will be discussed further below.

As opposed to the internal centers disclosed in U.S. Pat. No. 4,945,981, the internal center 40 of the present invention extends along the entire surface of the plates 5 for providing increased strength to the aluminum plate oil cooler 2. The embossments 35 are sized and configured such that the interior center 40 extends around the embossment 35 inside the plate 5. Such an arrangement, has been demonstrated to increase the burst strength of the aluminum plate oil cooler by an additional 200 to 300 PSI.

The internal center 40 and plates 5 are sized such that the internal center 40, when placed in the oil flow path 30, has a clearance with the plates 5 that does not exceed 0.030 of an inch to eliminate oil bypass around the internal center 40. Maintaining such a clearance between the internal center 40 and the plates 5 increases the effectiveness of the internal center 40 by eliminating bypass around the center 40 which could reduce the thermal effectiveness of the oil cooler.

As stated above, the plates 5 are secured together along their perimeter 10 and encapsulate the internal center 40. The plates 5 are clinched together to form a continuous male/female flange 50 which eliminates the possibility of seam leakage when clinched. The plates 5 have a brazing clad placed on both sides of the plate to permanently attach the internal center within the plate, as well as to securely seal the continuous male/female flange 50. With reference to FIG. 5, it can be seen that the continuous male/female flange 50 provides three points 51, 52, 53 in which a brazed seal may be formed in a brazing operation. Such an orientation, minimizes the possibility of a leak.

With reference to FIGS. 1 and 2, an external center 15 is positioned between each of the plurality of pairs of plates 5 for increasing the heat transfer area from the plates 5 to a coolant. The external center 15 comprises a corrugated aluminum sheet that has a plurality of fins 17 formed thereon. The fins 17 comprise first and second planer surfaces 18, 19 that are joined by a bend 16. The fins 17 are formed such that the flow of coolant is perpendicular to the flow of oil in the internal oil flow path 30. As can be seen in FIGS. 1 and 2, the external center 15 covers the entire surface of the plates 5. This orientation provides a uniform internal load on the plates 5 during a brazing operation. The external load is provided by a brazing fixture and/or banding wires utilized during a brazing operation. The uniform internal load insures that a perfect bond between the interior center 40 and the plates 5 is created. The external center 15 includes holes 21 and 22 formed therein to correspond with the embossments 35. The holes 21 and 22 allow the external center 15 to completely surround the embossments 35 providing additional support to the region around the embossments 35.

Again, with reference to FIGS. 1 and 2, the aluminum plate oil cooler 2 of the present invention includes top and bottom reinforcements 20 and 25, respectively. The top and bottom reinforcements 20 and 25 are unclad, as opposed to the plates 5 to prevent the oil cooler 2 from brazing to a braze fixture during the brazing operation. The top reinforcement 20 may be made of any material which can braze to aluminum and exhibits the necessary structural properties to make a reinforcement. Because of the propensity of aluminum to erode or corrode under high fluid velocity conditions, it is advantageous to utilize a material for the reinforcement which demonstrates a high resistance to corrosion and/or erosion. The top reinforcement may be subjected to high fluid velocity conditions where the oil cooler is mounted such that it straddles a radiator inlet or outlet. Therefore, it is preferred that the top reinforcement comprise the 300 series of stainless steel, which is capable of brazing to aluminum, and demonstrates a high level of corrosion and erosion resistance.

In an alternative embodiment, the top reinforcement may include an extended flow diverter 60 that may further prevent failures from occurring by directing high velocity fluids away from the aluminum components of the aluminum plate oil cooler 2. With reference to FIGS. 7, it can be seen that the flow diverter 60 comprises an extension of the top reinforcement that extends outboard of the plates 5; thereby protecting them from corrosion or erosion from high velocity fluids from a radiator inlet or outlet.

For situations where the aluminum plate oil cooler 2 has a plate stack height, meaning the number of plates that is only a small percentage of the radiator tank's width, the coolant has an opportunity to bypass the oil cooler 2. In such a situation, the bottom reinforcement 25 can include a baffle 67. With reference to FIG. 8, there is shown a sectional view of an oil cooler 2 within a radiator tank that includes a baffle 67. The baffle 67 comprises an angled plate 69 that is formed at an angle of approximately 90 degrees to the bottom reinforcement 25 to direct the flow of coolant between the pairs of plates 5 of the aluminum plate oil cooler 2.

While preferred embodiments are disclosed, a worker in this art would understand that various modifications would come within the scope of the invention. Thus, the following claims should be studied to determine the true scope and content of this invention.

What is claimed is:

1. A plate oil cooler comprising:

a plurality of pairs of plates secured together along their perimeter, said plates spaced from each other, thereby defining an oil flow path, said plates including embossed regions formed thereon for providing inlet and outlet ports for oil, top and bottom reinforcement plates positioned on a top and bottom of said plurality of pairs of plates; and an internal center positioned between said plates in thermal contact with said plates and within said oil flow path for transferring heat from the oil within the oil flow path to said plates;

an external center positioned between each of said plurality of pairs and in thermal contact with said plates for increasing the heat transfer from said plates to a coolant;

said external center comprising a corrugated aluminum sheet having a plurality of fins having first and second planar surfaces joined by a bend, said fins formed thereon such that the flow of coolant is perpendicular to the flow of oil;

said external center covering the entire surface of said plates and including holes formed therein to correspond with said embossed regions for providing a uniform internal load on said plates to ensure a bond between said internal center and said plates during a brazing operation.

2. The plate oil cooler of claim 1, wherein the internal center extends along the entire surface of said plates for providing increased strength to the aluminum plate oil cooler.

3. The plate oil cooler of claim 1, wherein a clearance between said internal center and said plates is less than 0.030 inches for eliminating oil bypass around said internal center.

4. The plate oil cooler of claim 1, wherein said plates are secured together along their perimeter such that there are 3 sites where a braze joint may be formed in a brazing operation.

5. The plate oil cooler of claim 1, wherein said top and bottom reinforcement plates are unclad for preventing a braze fixture brazing to said top and bottom reinforcement plates during a brazing operation.

6. The plate oil cooler of claim 1, wherein said top reinforcement comprises stainless steel.

7. The plate oil cooler of claim 1, wherein said top reinforcement comprises 300 series stainless steel.

8. The plate oil cooler of claim 1, wherein said top reinforcement plate further includes an extended flow director portion formed thereon for preventing failures of said oil cooler when said oil cooler straddles a radiator inlet or outlet.

9. The plate oil cooler of claim 1, wherein said bottom reinforcement further includes a baffle formed thereon for directing the flow of a coolant.

* * * * *